US006164486A

United States Patent [19]

Jackson et al.

[11] Patent Number: 6,164,486

[45] Date of Patent: Dec. 26, 2000

[54] INTEGRAL TELESCOPING VESSEL JOINT AND METHOD FOR USING THE SAME

[75] Inventors: Barry Nield Jackson, Woodbury; Gary W. Gauer, Cottage Grove; Ronald Iannelli, Burnsville, all of Minn.

[73] Assignee: Water Heater Innovations, Inc., Eagan, Minn.

[21] Appl. No.: 09/304,018

[22] Filed: May 3, 1999

[51] Int. Cl.[7] ..... B65D 8/04

[52] U.S. Cl. ..... 220/612; 220/672; 220/567.3

[58] Field of Search ..... 220/672, 612, 220/4.26, 4.03, 567.3

[56] References Cited

U.S. PATENT DOCUMENTS

| | | | |
|---|---|---|---|
| 1,807,912 | 6/1931 | Hansson | 220/672 |
| 4,736,509 | 4/1988 | Nelson . | |
| 5,386,925 | 2/1995 | Lane . | |

FOREIGN PATENT DOCUMENTS

| | | | |
|---|---|---|---|
| 0795408 | 5/1958 | United Kingdom | 220/612 |

*Primary Examiner*—Paul T. Sewell
*Assistant Examiner*—Troy Arnold
*Attorney, Agent, or Firm*—Moore & Hansen

[57] ABSTRACT

Access to the interior of a vessel during fabrication and assembly of the vessel is provided by a channel structure formed around the circumference of the vessel. The channel structure comprises an outer surface that is radially inwardly offset from the exterior surface of the vessel around the circumference of the vessel. The outer surface of the channel structure is bounded by upper and lower circumferential transition areas which join the outer surface of the channel structure to the surface of the vessel. The channel structure is arranged such that when an upper portion of the vessel is separated from a base portion of the vessel by removing the material comprising the upper transition area, the upper portion of the vessel will receive within its inner diameter the outer surface of the channel structure.

16 Claims, 3 Drawing Sheets

INTEGRAL TELESCOPING VESSEL JOINT AND METHOD FOR USING THE SAME

FIELD OF THE INVENTION

The present invention relates to the fabrication of containers such as a vessel or shell for containing fluids or for isolating a sensitive structure from its environment. More specifically, the present invention is drawn to a joint structure for facilitating the sectioning and reassembly of such vessels or shells.

BACKGROUND OF THE INVENTION

Often it is necessary to provide access to the interior of a vessel or shell. This may be accomplished by providing a man-way or door through a wall of the vessel or shell or by removing a section of the shell or vessel to expose the interior thereof. Adding a manway or a door to a vessel increases the cost of fabrication of the vessel and increases the likelihood that the vessel will leak or otherwise permit communication between the interior of the vessel and the environment in which the vessel is located. Similarly, removing a section of the wall of a vessel in order to access the interior of the vessel requires that the opening made through the wall of the vessel be resealed either by replacing the removed section or by applying a patch over the opening. However, neither replacing the removed section nor the application of a patch to the opening through the wall of the vessel is cost effective or an efficient way of closing an opening through the wall of a vessel. Therefore, it would be desirable to provide a structure and method for quickly, easily, and cost effectively gaining access to the interior of a vessel or shell and subsequently closing the shell or vessel in a manner that maintains the integrity of the vessel. It would also be desirable to provide a method for simultaneously producing a series of vessels having varying volumes from a single uniformly sized vessel.

SUMMARY OF THE INVENTION

The present invention is intended for use on a vessel that is the outer shell of a water heater. However, it must be understood that the present invention may have applications outside this narrow use and therefore the scope of the present invention is not to be limited thereto.

The present invention is essentially a structure that is formed integral to a vessel for facilitating the sectioning and reassembly of the vessel. The structure comprises a circumferential channel that is formed into the wall of a hollow, thin walled vessel. The circumferential channel has an outer surface that is substantially parallel to the wall of the vessel and two circumferential transition surfaces that are disposed between the outer surface of the channel and the surface of the vessel. The channel is arranged such that the outer diameter of the outer surface of the channel is smaller than the inner diameter of the vessel. In this way, the outer surface of the channel may be received within the inner diameter of the vessel where a base portion of the vessel has been sectioned from an upper portion of the vessel by removing the material which makes up the upper transition surface of the channel.

The channel structure may also comprise an outwardly radiused portion formed immediately adjacent to a lower circumferential transition area such that the lower peripheral edge of the upper portion of the vessel may rest upon a lip formed by the outwardly radiused portion when the outer surface of the channel structure is received within the inner diameter of the upper portion of the vessel. In addition, the channel structure may also comprise a circumferential ridge structure formed into the outer surface of the channel. Such a ridge structure would extend radially outwardly from the outer surface of the channel such that when the outer surface of the channel is received within the inner diameter of the upper portion of the vessel, the ridge structure will contact the surface of the inner diameter of the upper portion of the vessel around substantially the entire circumference of the inner diameter of the upper portion of the vessel.

Various means for securing the upper portion of the vessel to the base portion of the vessel have been contemplated. The respective portions of the vessel may be secured together using an adhesive, a welding procedure, or by means of a relatively rigid insulating material that at least partially fills the interior of the vessel and which extends between the base portion and the upper portion of the vessel, thereby preventing the base portion of the vessel from moving relative to the upper portion of the vessel.

Alternatively, the present invention may comprise a circumferential structure formed into the wall of a hollow, thin-walled vessel. The structure has a cylindrical surface that is substantially parallel to the wall of the vessel and a first and second circumferential transition surfaces, each transition surface being formed between the cylindrical surface of the circumferential structure and the surface of the vessel. The inner diameter of the cylindrical surface of the structure is larger than the outer diameter of the upper portion of the vessel such that where the vessel has been sectioned into an upper portion and a base portion by removing the entire upper circumferential transition surface of the channel, the circumferential structure will facilitate the re-assembly of the vessel by receiving the lower edge of the upper portion of the vessel therein.

DETAILED DESCRIPTION OF THE INVENTION

Figure 1:
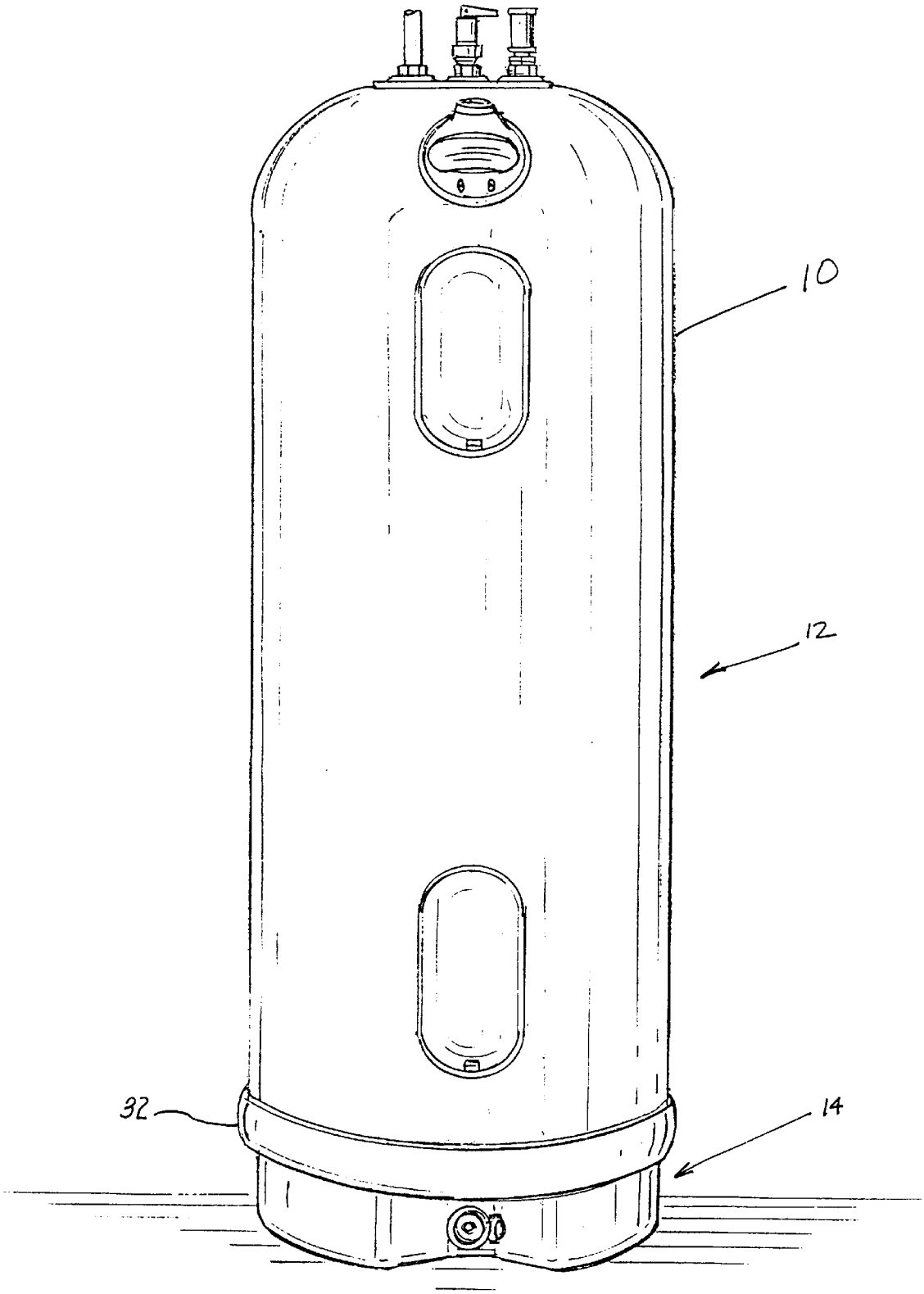
FIG. 1 is a fall, front elevation view of a fully assembled vessel fabricated according to the present invention.
Figure 2:
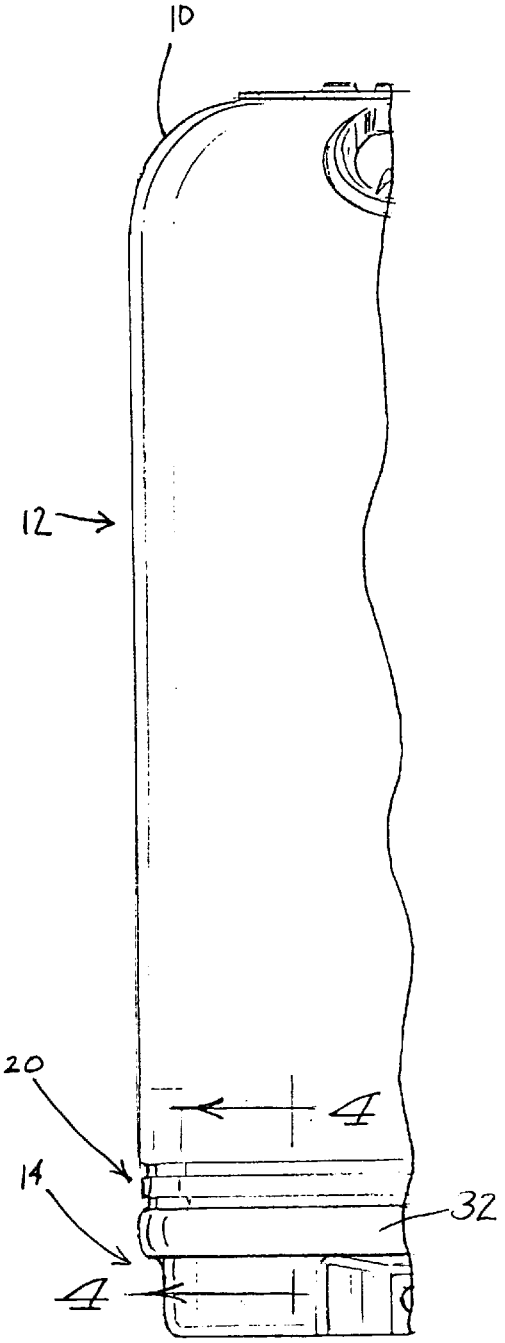
FIG. 2 is a front sectional view of the vessel of FIG. 1 prior to final assembly which illustrates the channel structure of the present invention.
Figure 3:
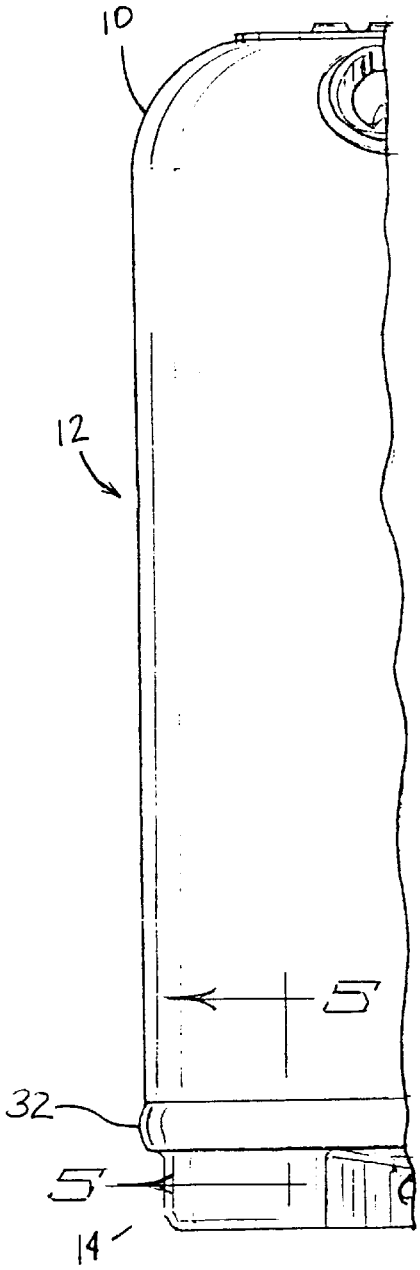
FIG. 3 is a front sectional view of the fully assembled vessel of FIG. 1.
Figure 4:
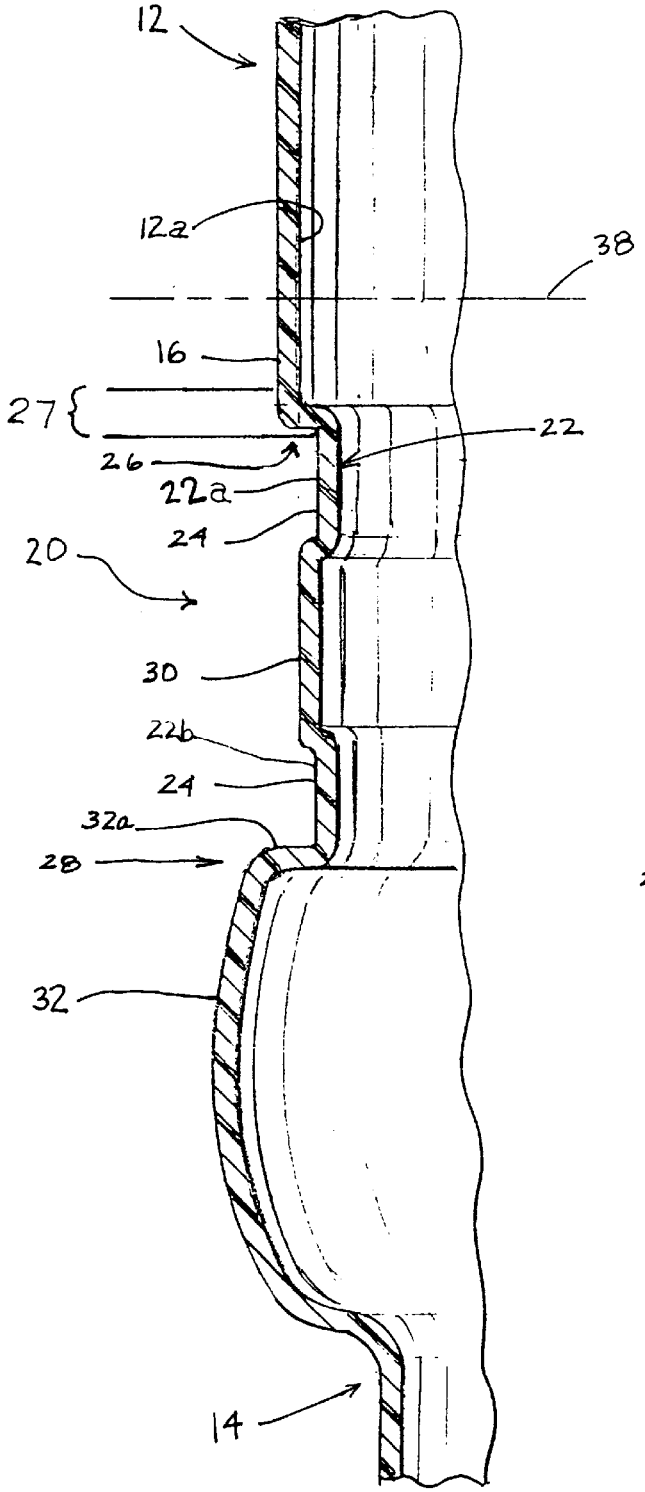
FIG. 4 is a close up sectional view of the channel structure of the present invention prior to final assembly of the vessel taken along section lines 4—4 of FIG. 2; and, FIG. 5 is a close up sectional view of the channel structure of the present invention after final assembly of the vessel taken along section lines 5—5 of FIG. 3.

FIGS. 1 and 3 illustrate a fully assembled vessel or shell 10 constructed according to the present invention. FIGS. 2 and 4 illustrate a vessel 10 which incorporates the channel structure 20 of the present invention as viewed prior to sectioning and re-assembly of the vessel 10. The vessel 10 illustrated in the Figures is typically fabricated as a single construction utilizing a well known blow molding technique from a plastic or other suitably rigid material. It is to be understood that vessel 10 or a structural equivalent thereof, may be fabricated in many different sizes and shapes, and may also be fabricated from materials including, but not limited to, steel, aluminum, or fiberglass. Furthermore, the particular process of fabricating a vessel 10 is not to be limited to a blow molding process. The vessel 10 is divided by the channel structure 20 into an upper portion 12 and a base portion 14. In order for the present invention to function properly, at least the upper portion 12 of the vessel 10 must have walls defining an inside diameter large enough to facilitate the insertion of the base portion of the vessel into the upper portion 12 of the vessel as set forth in more detail below enclosing a space that is defined by the inner diameter of the upper portion 12 of the vessel 10.

FIG. 4 illustrates a cross section of the channel structure 20. The channel structure 20 extends around the entire circumference of the vessel 10 and is comprised of a channel 22 having upper and lower channel segments 22*a* and 22*b* that are radially inwardly offset from the outer surface 16 of the upper portion 12 of the vessel 10. The channel 22 has an outer surface 24 bounded by a first or upper transition area 26 and a second or lower transition area 28. The first and second transition areas 26,28 join the outer surface 24 of the channel 22 to the respective upper and base portions 12, 14 of the vessel. In addition, the first transition area 26 is the line of demarcation between the upper portion 12 and the base portion 14 of the vessel 10.

A radially outwardly extending circumferential ridge structure 30 is formed into the outer surface 24 of the channel 22. The circumferential ridge structure 30 may be of any desirable shape and may be omitted if so desired. Abutting the second or lower transition area 28 of the channel structure 20 is a radially outwardly extending circumferential radiused ring 32.

Figure 5:
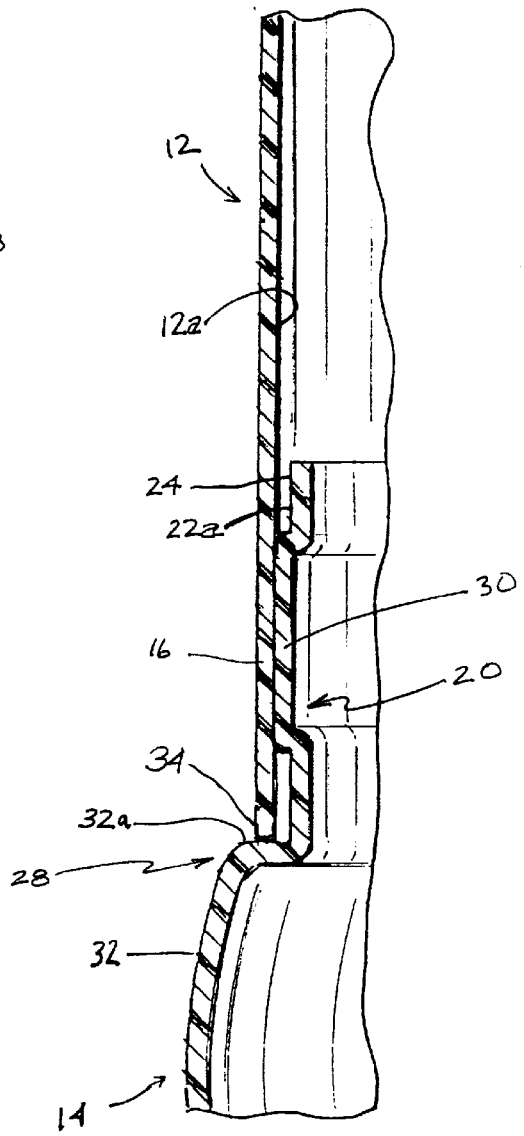

In order to access the interior of vessel 10, the vessel is sectioned by removing the material that makes up the first or upper transition area 26, the material being indicated by sectioned portion 27. Once the vessel 10 has been sectioned, any tasks requiring access to the interior of the vessel 10 may be performed. In the preferred embodiment of the present invention the requisite interior parts of a water heater (not shown) are assembled and inserted into the interior of the vessel 10. After assembly and installation of the water heater interior parts (not shown), it is necessary to reattach the base portion 14 of the vessel 10 to the upper portion 12 of the vessel 10 as illustrated in FIGS. 3 and 5. The re-attachment is accomplished by inserting the outer surface 24 of the channel 22, which is in this preferred embodiment essentially cylindrical in shape, into the inner diameter of the upper portion 12 of the vessel 10. When the base portion 14 has been fully inserted into the upper portion 12, a lower peripheral edge 34 of the upper portion 12 is brought into contact with a shoulder 32*a* formed at the lower transition area 28 by the radiused ring 32, as shown in FIG. 5. Furthermore, the ridge structure 30 formed into the outer surface 24 of the channel 22 contacts the surface 12*a* of the inner diameter of the upper portion 12 of the vessel 10 around its entire circumference so as to create a mechanical seal between the upper and base portions 12, 14 of the vessel 10.

Where the vessel 10 is made of a synthetic material such as a plastic or a composite such as fiberglass, the upper portion 12 and the base portion 14 may be secured together using an adhesive. Or, where the vessel 10 is made from a metallic substance such as steel or aluminum, the upper and base portions 12, 14 may be secured together utilizing a welding operation suitable to the material from which the vessel 10 is fabricated. The upper and base portions 12, 14 of the vessel 10 may also be fused together as by induction heating or the like. Another method for securing the upper and base portions 12,14 together, and the method utilized in the preferred embodiment of the present invention to achieve this end, is to fill the open space between the upper and base portions 12, 14 and an inner vessel (not shown) of a water heater disposed within the vessel 10 with a substantially rigid foam material (not shown) that also has insulative properties. Because the foam spans the joint created by the channeled structure 20 and because the foam material adheres to both the upper and base portions 12, 14 of the vessel 10, the foam material unifies the upper and base portions 12, 14, effectively creating a single structure. The radiused shoulder 32 of the base portion 14 aids in securing the base portion 14 to the upper portion 12 in that the shear strength of the foam material filling the expanded inner diameter of the radiused portion 32 prevents the base portion 14 from sliding away from the upper portion 12. It is to be understood that the radiused shoulder 32 is optional. The lower transition area 28 creates a sufficient shoulder 32*a* to act as a stop for the lower peripheral edge 34 of the upper portion 12 of the vessel 10.

The structure of the vessel 10 also lends itself to the production of a series of vessels having identical diameters and varying volumes. Modifying the above-described vessel 10 to create a series of vessels having varying volumes involves modifying the height of the upper portion 12 vessel 10. Simultaneous with the sectioning of the vessel 10 at upper transition zone 26, the body of the upper portion 12 of the vessel 10 may be cut around its entire circumference parallel with the cut that removes the upper transition zone 26. The circumferential cut made in the upper portion 12 of the vessel is located a predetermined distance from the upper transition zone 26 such that the reassembled upper and lower portions 12 and 14 of the vessel 10 define a vessel having a desired volume. Such a cut line 38 is indicated by way of example in FIG. 4. By varying the vertical location of the circumferential cut the volume of the resulting vessels 10 may be easily and quickly modified. The cylindrical section removed from the upper portion 12 of the vessel 10 may be discarded, or, in the case of a plastic molding operation, be recycled for reuse in molding additional vessels 10. As each vessel 10 has a constant cross section over substantially its entire height, the lower edge of the upper portion 12 of the vessel 10 created by the circumferential cut will be able to receive the lower portion 14 of the vessel as described above.

An alternative to the above described channel structure 20 may comprise a protruding circumferential structure (not shown) having an inner diameter that is larger than the outer diameter of the outer surface 16 of the upper portion 12 of the vessel 10. Like the channel structure 20 described above, the protruding circumferential structure has upper and lower transition surfaces. By removing the upper transition surface in a manner identical to the removal of the upper transition surface 26 of the channel structure 20, a vessel 10 incorporating a protruding circumferential structure may be sectioned into upper and lower portions 12, 14. However, in this application, reassembly of the vessel 10 will be accomplished by sliding the upper portion 12 of the sectioned vessel 10 into the inner diameter of the protruding circumferential structure. The upper portion 12 of the now reassembled vessel 10 is retained in the protruding circumferential structure by means of adhesives, welding, or by a substantially rigid foam as described above.

Use of the present invention begins with the step of forming a vessel 10 incorporating a channel structure 20 which extends around the entire circumference of the vessel 10. The vessel 10 may be curvilinear, rectilinear or irregularly shaped depending upon the application for which the vessel 10 is intended. Next, first or upper transition area 26 is removed using a cutting tool (not shown) which may be a standard router, cutting torch, or other appropriate cutting device. Removal of the material which makes up the upper transition area 26 effectively separates the upper portion 12 from the base portion 14 and permits easy access to the interior of the vessel 10. Any activities requiring access to the interior of the vessel 10 such as the placement of required components within the vessel or treatment of the interior surface of the vessel are then performed. Finally, the wall of the base portion 14 that comprises the outer surface 24 of the channel 22 is inserted into the inner diameter of the upper portion 12 until the lower peripheral edge 34 of the upper portion 12 of the vessel 10 contacts the shoulder 32*a* created by the radiused ring 32 at the transition area 28 of the base portion 14. The base portion 14 is then secured to the upper portion 12 by means of adhesives, or by the injection of a substantially rigid foam material into the interior space defined by the walls of the upper and base portions 12, 14.

This description is intended to provide a specific example of an individual embodiment which clearly discloses the present invention. Accordingly, the invention is not limited to the described embodiment, or to the use of the specific elements described therein. For example, those skilled in the art would recognize that the present invention may be implemented in such a manner that the upper portion 12 of the vessel 10 would be inserted into the base portion 14. In addition, the channel structure 20 may also be formed so as to be radially outwardly offset from the surface of the vessel 10. All alternative modifications and variations of the present invention which fall within the spirit and broad scope of the appended claims are covered.

What is claimed is:

1. A structure for facilitating the sectioning and reassembly of a vessel, the structure comprising:

a circumferential channel formed integral with a wall of a hollow, contiguous, fluid containing vessel having opposed closed ends, the channel having an outer surface substantially parallel to the wall of the vessel and upper and lower circumferential transition surfaces, each transition surface being formed between the outer surface of the channel and the surface of the vessel; and, the outer diameter of the outer surface of the channel being inwardly radially offset from an inner surface of the vessel so as to be smaller than the inner diameter of an upper portion of the vessel, such that the outer surface of the channel may be received within the inner diameter of the vessel where the vessel has been sectioned into an upper portion and a base portion by removing the entire upper circumferential transition surface of the channel.

2. A hollow vessel having an inner diameter and a channel structure formed around its circumference, the channel structure comprising:

an outer surface that is radially inwardly offset from the inner surface of the vessel around the circumference of the vessel, the outer surface being bounded by upper and lower circumferential transition areas which join the outer surface of the channel structure to the wall of the vessel;

the channel structure being constructed and arranged such that upon an upper portion of the vessel being separated from a base portion of the vessel by removing the material comprising the upper transition area, the upper portion of the vessel may receive within its inner diameter the outer surface of the channel structure and a lower peripheral edge of the upper portion may abut against the lower transitional area of the base portion of the vessel, and the outer surface of the channel may contact the inner surface of the upper portion of the vessel upon inserting the outer surface of the channel structure into the inner diameter of the upper portion of the vessel.

3. The vessel of claim 2 wherein the base portion of the vessel further comprises a circumferential outwardly radiused portion formed immediately below and adjacent to the lower circumferential transition area, the radiused portion forming a shoulder upon which the lower peripheral edge of the upper portion of the vessel rests.

4. The vessel of claim 2 further comprising a circumferential ridge structure formed into the outer surface of the channel, the ridge structure extending radially outwardly such that when the outer surface of the channel structure is received within the inner diameter of the upper portion, the ridge structure will contact the surface of the inner diameter of the upper portion around substantially the entire circumference of the inner diameter of the upper portion of the vessel.

5. The channel structure of claim 2 wherein the upper portion of the vessel is separated from the base portion of the vessel by removing the material comprising the upper transition area, the upper portion of the vessel receiving within its inner diameter the outer surface of the channel structure and the lower peripheral edge of the upper portion being brought into contact with the lower transitional area of the base portion of the vessel and wherein the upper portion and the base portion of the vessel are secured together using an adhesive.

6. The channel structure of claim 2 wherein the upper portion of the vessel is separated from the base portion of the vessel by removing the material comprising the upper transition area, the upper portion of the vessel receiving within its inner diameter the outer surface of the channel structure and the lower peripheral edge of the upper portion being brought into contact with the lower transitional area of the base portion of the vessel and wherein the upper portion and the base portion of the vessel are secured together using a welding procedure.

7. The vessel of claim 2 wherein the upper portion of the vessel is separated from the base portion of the vessel by removing the material comprising the upper transition area, the upper portion of the vessel receiving within its inner diameter the outer surface of the channel structure and the lower peripheral edge of the upper portion being brought into contact with the lower transitional area of the base Portion of the vessel and wherein the upper portion and the base portion of the vessel are secured together by means of a substantially rigid insulating material that at least partially fills the interior of the vessel and which extends between the base portion and the upper portion of the vessel, there by mechanically preventing relative motion between the base and upper portion of the vessel.

8. A structure formed integral to a hollow, thin-walled vessel for facilitating the sectioning and reassembly of the vessel, the vessel, the structure comprising:

a circumferential protrusion formed into the wall of the vessel, the protrusion having a cylindrical-outer surface substantially parallel to the wall of the vessel and a first and a second circumferential transition surface, each transition surface being formed at the boundaries between the cylindrical outer surface of the protrusion and the surface of the vessel;

an inner diameter of the cylindrical outer surface of the protrusion being larger than the outer diameter of an upper portion of the vessel, such that upon sectioning the vessel into an upper portion and a base portion by removing the entire upper circumferential transition surface of the protrusion, the cylindrical outer surface of the protrusion may receive the outer diameter of the upper portion of the vessel therein and the inner diameter of the outer surface of the channel may contact the outer diameter of the surface of the upper portion of the vessel.

9. A water heater of generally cylindrical shape comprising:

an upper portion and a lower portion that at least initially comprise a contiguous vessel, the upper portion comprising a single side wall having a closed upper end and inner and outer surfaces and a lower peripheral edge;

the lower portion comprising a single, continuous wall deformed radially inwardly to define a circumferential channel integrally formed on its upper end, the channel having an outer surface that is substantially parallel to the wall of the vessel upper portion and a transition surface at its lower end, and the outer surface of the channel being received within the inner surface of the upper portion wall with the lower peripheral edge of the upper portion wall being in contact with the transition surface of the base portion outside of the channel and the outer surface of the channel being in contact with the inner surface of the upper portion of the vessel.

10. The water heater of claim 9 wherein:

the base portion further comprises a circumferentially outwardly projecting portion formed immediately below the transition surface and defining there with a shoulder on which the lower peripheral edge of the upper portion wall rests.

11. The vessel of claim 1 wherein a predetermined final volume of the vessel is achieved by removing a predetermined portion of the upper portion of the vessel adjacent the upper transition surface.

12. A method of sectioning and reassembling a hollow, thin-walled vessel comprising the steps of:

forming a unitary vessel body having a circumferential channel formed integral with a wall of a hollow, contiguous, fluid containing vessel having opposed closed ends, the channel having an outer surface substantially parallel to the wall of the vessel and upper and lower circumferential transition surfaces, each transition surface being formed between the outer surface of the channel and the surface of the vessel and the outer diameter of the outer surface of the channel being inwardly radially offset from an inner surface of the vessel so as to be smaller than the inner diameter of an upper portion of the vessel, such that the outer surface of the channel may be received within the inner diameter of the vessel where the vessel has been sectioned into an upper portion and a base portion by removing the entire upper circumferential transition surface of the channel;

sectioning the unitary vessel body into an upper portion having an inner diameter surface and a base portion by removing the material that forms the upper transition surface; and reassembling the upper and lower portions of the sectioned vessel into a unitary vessel body by inserting the outer surface of the channel structure of the base portion into the inner diameter surface of the upper portion.

13. The method of sectioning and reassembling a hollow, thin-walled vessel of claim 12 further comprising the step of:

introducing a substantially rigid foam material inside of the vessel body to span the channel structure where the upper and lower portions of the vessel are joined so as to secure the upper portion of the vessel to the base portion of the vessel.

14. The method of sectioning and assembling a hollow, thin-walled vessel of claim 12 further comprising the step of:

removing a cylindrical section of predetermined height from the upper portion of the vessel prior to reassembly to alter the volume and size of the assembled vessel.

15. The method of sectioning and assembling a hollow, thin-walled vessel of claim 14 further comprising the step of:

removing the cylindrical section of predetermined height from the upper portion of the vessel substantially simultaneously with the removal of the upper transition surface of the channel structure.

16. The method of sectioning and assembling a hollow, thin-walled vessel of claim 15 further comprising the step of:

causing a substantially rigid foam material to span the channel structure where the upper and lower portions of the vessel are joined so as to secure the upper portion of the vessel to the lower portion of the vessel.

* * * * *